United States Patent [19]

Freeman

[11] Patent Number: 4,576,522

[45] Date of Patent: Mar. 18, 1986

[54] RUPTURABLE CLOSURE

[75] Inventor: Tommie A. Freeman, Duncan, Okla.

[73] Assignee: Halliburton Company, Duncan, Okla.

[21] Appl. No.: 653,803

[22] Filed: Sep. 21, 1984

[51] Int. Cl.[4] ..... E02B 17/00

[52] U.S. Cl. ..... 405/225; 138/89; 405/195; 405/224; 405/227

[58] Field of Search ..... 405/195, 203–208, 405/224–227; 206/616, 601, 604, 609; 138/89, 94

[56] References Cited

U.S. PATENT DOCUMENTS

| | | | |
|---|---|---|---|
| 1,732,282 | 10/1929 | Sage | 206/616 X |
| 2,402,093 | 6/1946 | Schermuly et al. | 206/616 X |
| 2,760,714 | 8/1956 | Rasmussen | 206/616 |
| 3,474,630 | 10/1969 | Pogonowski . | |
| 3,533,241 | 10/1970 | Bowerman et al. . | |
| 3,613,381 | 10/1971 | Cox . | |
| 4,024,723 | 5/1977 | Mayfield et al. . | |
| 4,087,978 | 5/1978 | Landers . | |
| 4,124,988 | 11/1978 | Landers . | |
| 4,142,371 | 3/1979 | Mayfield et al. . | |
| 4,145,158 | 3/1979 | Britton et al. | 405/208 |
| 4,175,592 | 11/1979 | Coone . | |
| 4,178,112 | 12/1979 | Knox . | |
| 4,183,698 | 1/1980 | Coone . | |
| 4,212,563 | 7/1980 | Weidler et al. . | |
| 4,220,422 | 9/1980 | Sullaway . | |
| 4,230,424 | 10/1980 | Sullaway . | |
| 4,322,181 | 3/1982 | Streich . | |
| 4,367,983 | 1/1983 | Streich . | |
| 4,373,835 | 2/1983 | Haney . | |
| 4,376,597 | 3/1983 | Britton et al. . | |
| 4,470,726 | 9/1984 | Helms . | |
| 4,474,509 | 10/1984 | Antes et al. | 405/205 |

*Primary Examiner*—Dennis L. Taylor

*Attorney, Agent, or Firm*—James R. Duzan; Thomas R. Weaver

[57] ABSTRACT

An improved diaphragm assembly for use in sealing annular members of marine structures comprising a diaphragm, a pair of flat annular plates and a rip-out assembly.

18 Claims, 4 Drawing Figures

RUPTURABLE CLOSURE

BACKGROUND OF THE INVENTION

This invention relates to an improved closure or diaphragm assembly for offshore platforms and the like used in well drilling and production where it is desired to remove a portion of the closure or diaphragm from the member on which it is installed.

Offshore platforms are generally fabricated in a harbor or on a shore location and are then towed to a marine site where they are tipped on end and lowered into position with the platform resting on the ocean floor. The platform legs are hollow structures having open ends so that pilings can be driven downwardly through the legs into subterranean formations below the floor of the marine site to anchor the platform in position.

It is desirable during platform setting operations to utilize the platform legs and/or pile sleeves for buoyancy to assist in the setting operations. In some instances, buoyancy tanks may be included on the offshore platform to add buoyancy above that provided by the legs and/or pile sleeves to the platform. It is also desirable to exclude foreign material from the platform leg and/or pile sleeve during platform setting operations to prevent the annulus between the piling and the leg and/or sleeve from becoming contaminated with foreign material which would prevent the filling of the annulus with grout or cement. Therefore, a closure structure which is easily severable when the piling is driven through the platform leg and/or pile sleeve is used to seal the end of the leg or sleeve during the setting of the platform.

Typical prior art closures or diaphragms are illustrated in U.S. Pat. Nos. 3,533,241; 4,087,978; 4,124,988; 4,178,112; 4,220,422; 4,230,424; 4,367,983; and 4,470,726. However, as such closures or diaphragms are fabricated for use on offshore platforms in deeper and deeper water depths, of necessity, the number of fabric reinforcing plies must be increased to increase the load bearing capacity of the closure or diaphragm. As the thickness of the closure or diaphragm increases it becomes increasingly difficult to pierce the closure with the piling to be driven through the platform leg or pile sleeve by merely dropping the piling upon the closure. If it becomes necessary to use the pile driving hammer upon the piling to cause the piling to pierce the diaphragm, such use is dangerous because the initial hammer blow may be of sufficient strength to not only cause the piling to pierce the closure but, also, cause the piling to be driven many feet into the floor of the marine site thereby suddenly unloading the pile driving hammer. If the pile driving hammer is unloaded suddenly, before the hammer may be stopped, the repeated unopposed blows of the hammer may cause substantial damage to the derrick on the derrick barge installing the offshore platform.

In this connection, while it has been proposed to use various devices to initially pierce the closure or diaphragm before driving the piling therethrough, the use of such devices is not an attractive option because such devices must be transported to and from the marine site and easily assembled and disassembled during repeated use during platform installation.

As an alternative to such prior art closures or diaphragms, it has been proposed to use frangible plate or disc closures or diaphragms to close the legs and/or pile sleeves of offshore platforms. Such typical prior art frangible plate or disc closures or diaphragms are described in U.S. Pat. Nos. 3,474,630; 3,613,381; 4,212,563; and 4,322,181. However, such frangible plate or disc closures or diaphragms are not generally satisfactory because they are difficult to fabricate, install and use, particularly where the repeatability of rupture strengths are desired.

Yet other types of releasable closures are described in U.S. Pat. Nos. 4,024,723; 4,142,371; 4,175,592; 4,183,698; 4,373,835; and 4,376,597.

However, the releasable closure described in the U.S. Pat. No. 4,024,723 patent is generally undesirable for use because the annular cutter used to pierce the diaphragm may be retained upon the end of the piling during the driving operation thereby causing the piling to deflect rather than driving straight.

The releasable closure described in the U.S. Pat. No. 4,142,371 patent is generally undesirable because it requires the molding and maintenance during molding of an annular wrapped continuous cable in a large amount of elastomeric material to form the releasable member. Even if the cable can be controlled during the molding process, after the removal of the closure from the platform leg and/or pile sleeve, a large residue of elastomeric material is retained on the leg or pile sleeve upon which a piling may foul upon insertion into the leg or pile sleeve.

Also, the closure described in the U.S. Pat. No. 4,376,597 patent may be difficult to install for satisfactory use as the elastomeric closure or diaphragm must be subjected to uniform forces retaining it between its annular retaining rims, otherwise, it will tend to pull free or pop-out from the retaining rims upon loading.

STATEMENT OF THE INVENTION

The present invention is directed to an improved closure or diaphragm assembly for use on offshore platforms and the like used in well drilling and production where it is desired to remove a portion of the closure or diaphragm from the member on which it is installed. The improved diaphragm assembly comprises a reinforced elastomeric diaphragm, a pair of flat annular plates, and a rip-out assembly.

FIG. an enlarged view of a portion of the present invention.

DETAILED DESCRIPTION OF THE INVENTION

Figure 1:
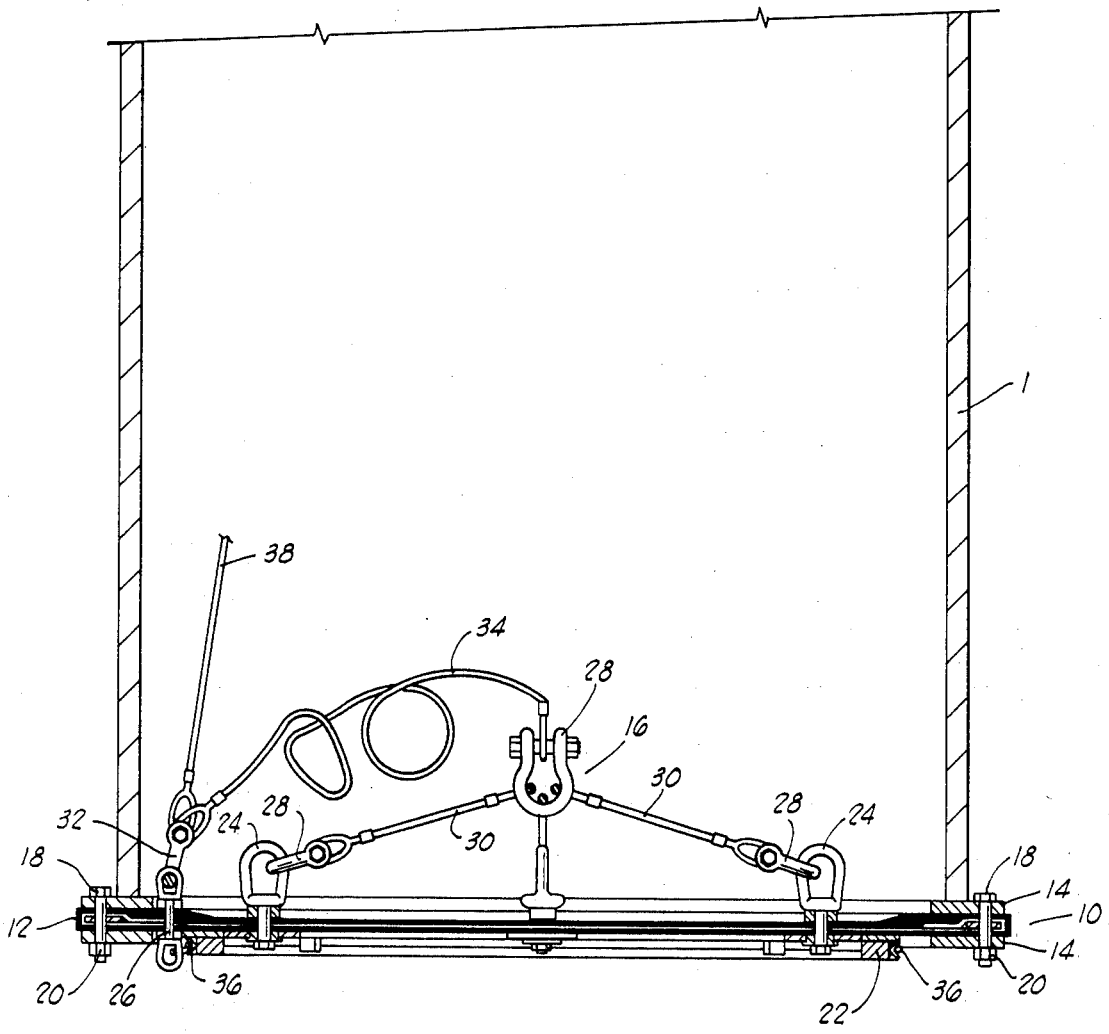
FIG. 1 is a cross-sectional view of the present invention installed on an annular member of a marine structure.

Referring to FIG. 1, the closure or diaphragm assembly 10 of the present invention is shown installed on an annular member 1 of an offshore platform or marine structure.

The diaphragm assembly 10 comprises diaphragm 12, a pair of flat annular plates 14, and diaphragm rip-out assembly 16.

The diaphragm 12 may be of the type described in U.S. Pat. Nos. 4,178,112; 4,220,422; 4,230,424; 4,367,983; or 4,470,726 whose disclosures are incorporated herein by reference thereto.

The flat annular plates 14 each comprise a circular annular member having a plurality of apertures therein for a plurality of threaded fasteners 18 to extend therethrough, each fastener 18 containing a nut 20 thereon.

The diaphragm rip-out assembly 16 comprises rip-out shim 22, shim eyebolts 24, rip-out eyebolt 26, shim shackles 28, shim cables 30, rip-out shackle 32 connected to rip-out eyebolt 26, connecting cable 34 and rip-out cable 36 having one end thereof secured to rip-out eyebolt 26 and the other end thereof secured to rip-out shim 22 and a length thereof preferably shorter than that of connecting cable 34, although this is not always necessary.

Also shown connected to rip-out shackle 32 is cable 38 which runs through the annular member 1 and is used to remove or rip-out a portion of the diaphragm 12 from the annular member 1.

Figure 2:
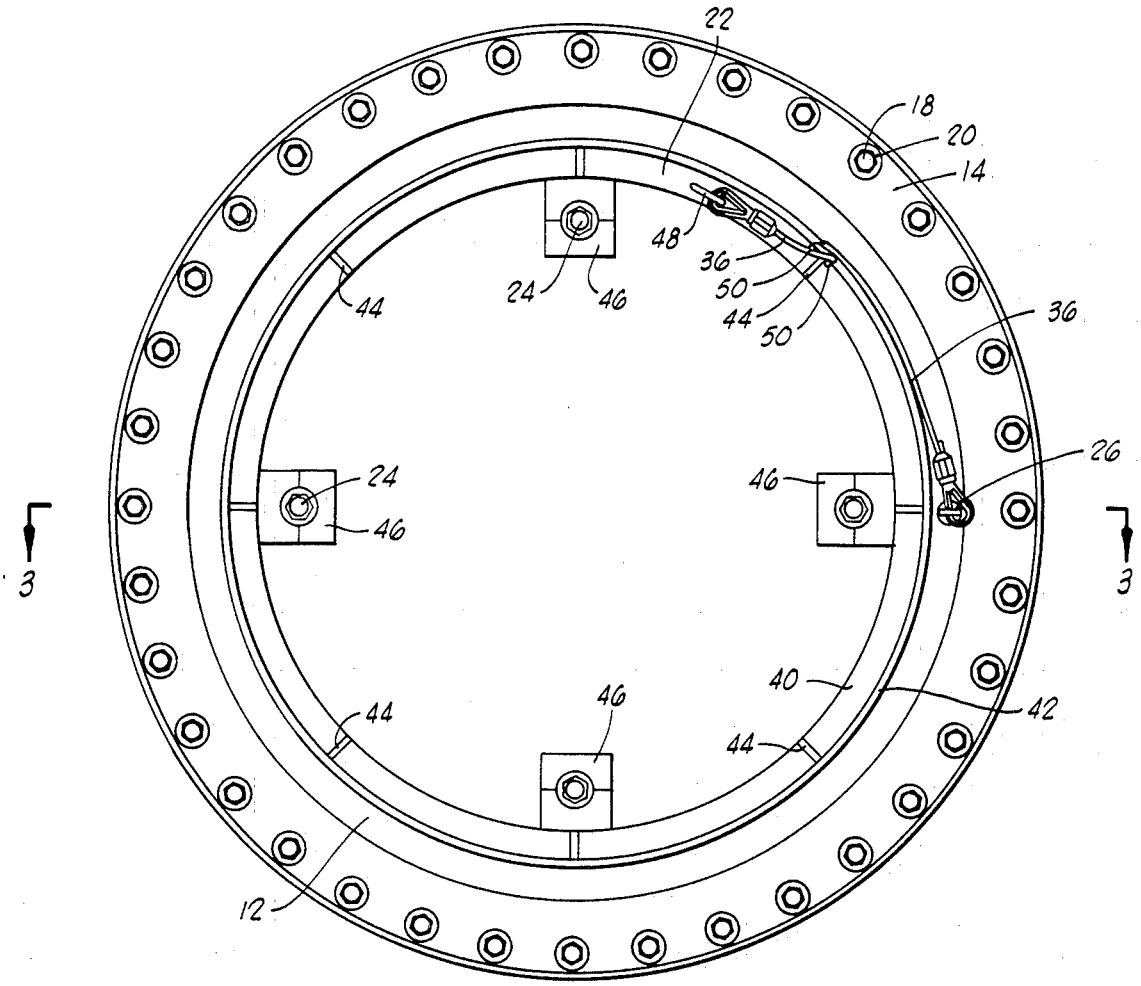
FIG. 2 is a bottom view of the reinforced elastomeric diaphragm of the present invention.

Referring to FIG. 2 the bottom of the diaphragm assembly 10 is shown as it is seen attached to one end of the annular member 1.

As shown, the rip-out shim 22 comprises an annular circular member 40 having secured thereto, circular V-shaped rip-out cable rim 42, a plurality of reinforcing members 44 which are secured to member 40 and rim 42, a plurality of eyebolt pads 46 against which the heads of eyebolts 24 bear, rip-out cable lug 48, and rip-out cable bearing pins 50.

The rip-out cable 36 is installed in or wrapped about rim 42 of rip-out shim 22 having an end secured thereto at cable lug 48 so that the cable 36 is wrapped at least one (1) full revolution about rim 42 and, preferably, approximately one and one-quarter revolutions about the rim 42 having the other end of cable 36 secured to rip-out eyebolt 26.

Figure 3:
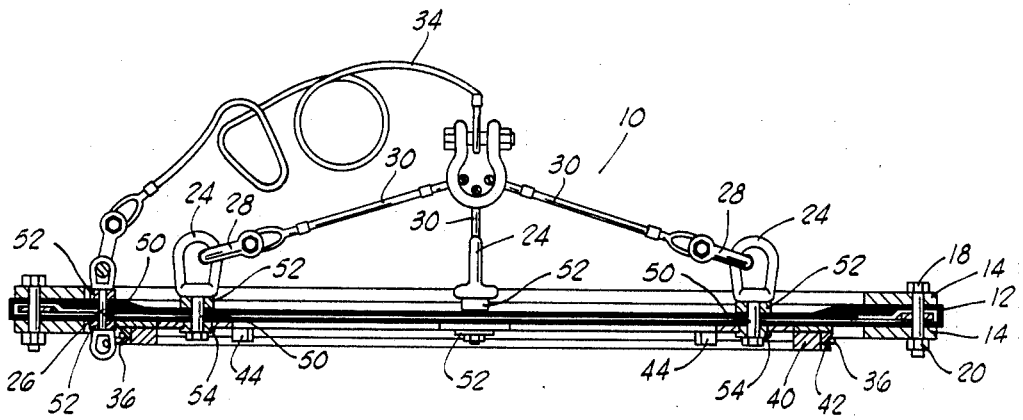
FIG. 3 is a cross-sectional view along line 3—3 of FIG. 2 of the reinforced elastomeric diaphragm of the present invention.

Referring to FIG. 3, the diaphragm assembly 10 of the present invention is shown in cross section.

As shown, the shim eyebolts 24 and rip-out eyebolt 26 extend through drilled apertures 50 in the diaphragm 12. To seal the apertures 50 in the diaphragm 12 and around shim eyebolts 24 and rip-out eyebolt 26 compression fittings 52 and 54 are used.

Figure 4:
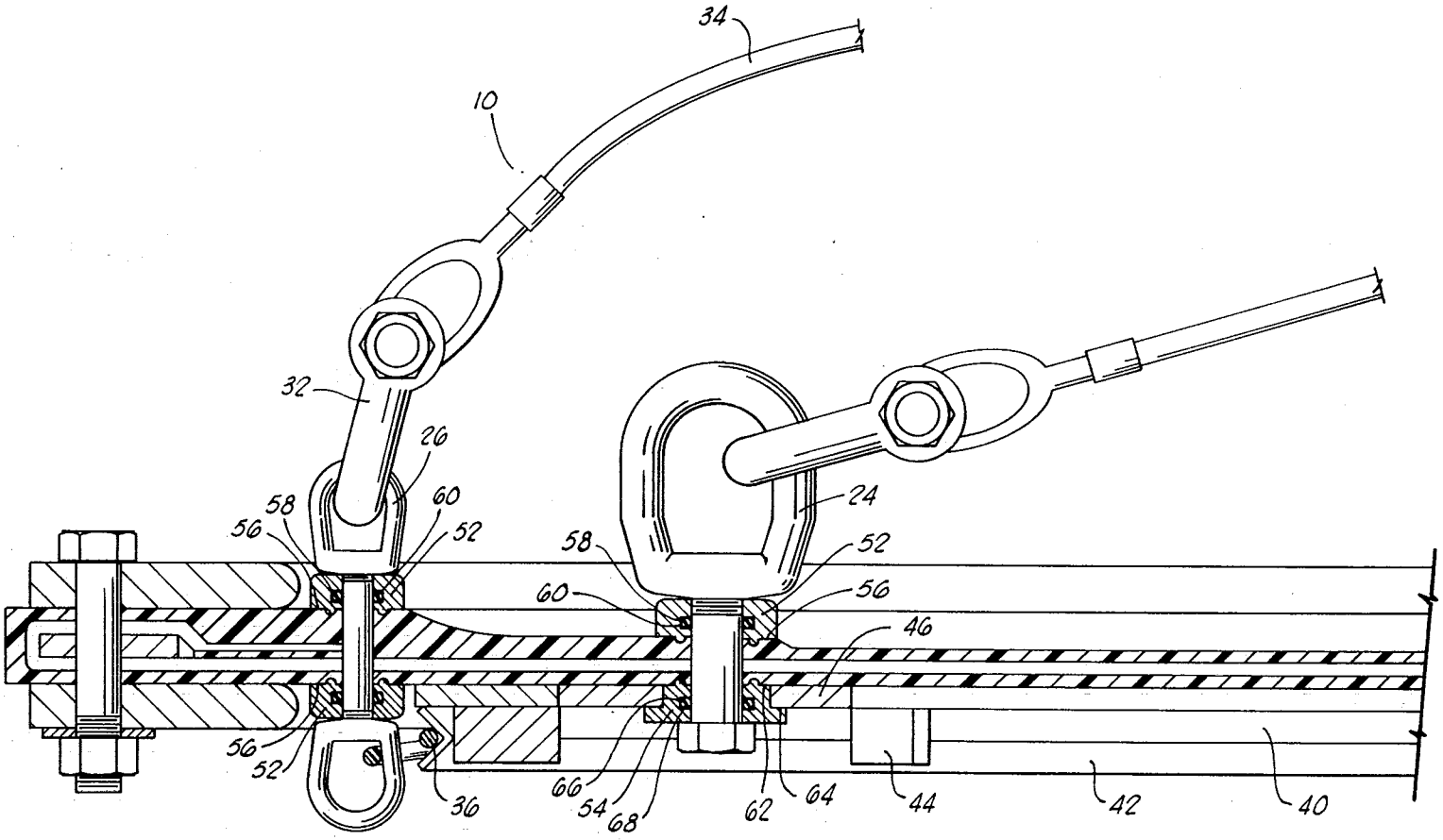

Referring to FIG. 4, a portion of the diaphragm assembly 10 of the present invention is shown.

Each compression fitting 52 comprises an annular circular member having an end surface 56 having an annular rib thereon which sealingly engages the surface of the diaphragm 12 and an annular recess 58 therein which, in turn, contains annular elastomeric seal 60 therein which sealingly engages the shim eyebolt 24 or rip-out eyebolt 26. Similarly, each compression fitting 54 comprises an annular circular member having an end surface 62 having an annular rib thereon which sealingly engages the surface of the diaphragm 12, an annular rim 64 which bears against eyebolt pad 46, and annular recess 66 which, in turn, contains annular elastomeric seal 68 therein which sealingly engages the shim eyebolt 24.

OPERATION OF THE INVENTION

Referring again to FIG. 1, to remove or rip-out a portion of the diaphragm 12 from the diaphragm assembly 10 the cable 38 is pulled by a suitable power means, such as derrick, winch, etc. Since the cable 38 is connected to rip-out shackle 32 which is, in turn, connected to rip-out eyebolt 26, the rip-out eyebolt 26 is pulled or ripped from the diaphragm 12. After the rip-out eyebolt 26 is pulled from the diaphragm 12, since the rip-out cable 36 has one end secured to the rip-out eyebolt 26, the continued movement of the rip-out eyebolt 26 away from the diaphragm 12 will cause the rip-out cable 36 to be ripped through the diaphragm 12 thereby severing the center portion of the diaphragm 12 from the periphery thereof retained between the flat annular plates 14. Since the rip-out cable 36 extends at least one (1) full revolution about rim 42, upon the pulling of rip-out cable 36 through diaphragm 12, the center portion of the diaphragm 12 is completely severed from the periphery thereof.

After the severing of the center portion of the diaphragm 12 from the periphery thereof, since one end of rip-out cable 36 is attached to rip-out eyebolt 26 while the other end thereof is secured to rip-out cable lug 48 of rip-out shim 22 and connecting cable 34 is secured to shim cables 30 which are, in turn, secured to shim eyebolts secured to rip-out shim 22, the continued movement of the movement of the rip-out eyebolt 26, connecting cable 34, and diaphragm shim 22 away from flat annular flanges 14 through member 1 allows the removal of the center portion of the diaphragm 12 from the annular member 1 via one end thereof.

It should be understood that the connecting cable 34 is of a length greater than that of the rip-out cable 36 so that the center portion of the diaphragm 12 may be severed before any forces are placed on the rip-out shim 22 to remove the center portion of the diaphragm 12 from the member 1.

It should be further understood that by severing the center portion of the diaphragm 12 from the periphery thereof an effective pile wiper may be formed by the periphery of the diaphragm assembly 10. By selecting the appropriate size of rip-out shim 22 the diameter of the inner lip of the newly created pile wiper formed by the periphery of the diaphragm assembly 10 may be controlled to the desired diameter to mate with the pile or other annular member to be installed through the annular member 1.

It will be appreciated that changes, substitutions and modifications may be made to the diaphragm assembly 10 of the present invention which are intended to be within the scope of the invention. Some examples of such changes, substitutions and modifications being that the shackles may be omitted and the connecting cable and the shim cables connected directly to the rip-out eyebolt and shim eyebolts, that the eyebolts may be replaced by other suitable type fastening means, etc.

Having thus described my invention, I claim:

1. A diaphragm assembly for use on annular members of marine structures, said diaphragm assembly comprising:

a diaphragm;

a pair of flat annular plates retaining the diaphragm therebetween, one of the flat annular plates being secured to said annular member; and a diaphragm rip-out assembly for removing a portion of the diaphragm from between the pair of flat annular plates, the rip-out assembly comprises:

a rip-out shim;

a rip-out eyebolt; and a rip-out cable having one end thereof secured to the rip-out eyebolt and the other end thereof secured to the rip-out shim.

2. The diaphragm assembly of claim 1 wherein the rip-out assembly further comprises:

a plurality of shim eyebolts securing the rip-out shim to the diaphragm;

a plurality of shim shackles;

a plurality of shim cables connecting the plurality of shim shackles; and a connecting cable having one end thereof connected to the rip-out eyebolt and the other end thereof to a shim shackles of the plurality of shim shackles.

3. The diaphragm assembly of claim 2 wherein the rip-out shim comprises:

an annular circular member having a cable rim secured thereto, a plurality of reinforcing members secured to the annular circular member and the cable rim secured thereto, a plurality of eyebolt pads, a rip-out cable lug, and at least one rip-out cable bearing pin.

4. The diaphragm assembly of claim 3 wherein the diaphragm assembly further comprises:

a plurality of compression fittings sealingly engaging the diaphragm, the rip-out eyebolt, and the plurality of shim eyebolts.

5. The diaphragm assembly of claim 4 wherein the rip-out cable is wrapped at least one full revolution about the cable rim portion of the rip-out shim.

6. The diaphragm assembly of claim 5 wherein the diaphragm assembly further comprises:

a plurality of fasteners securing the pair of flat annular plates and the diaphragm together.

7. A diaphragm assembly used to seal either the jacket leg or pile sleeve of an offshore platform, the diaphragm assembly comprising:

a diaphragm;

a pair of flat annular plates retaining the diaphragm therebetween, one of the flat annular plates being secured to either said jacket leg or said pile sleeve; and a diaphragm rip-out assembly for severing a portion of the diaphragm from between the pair of plates.

8. The diaphragm assembly of claim 7 wherein the rip-out assembly further comprises:

a plurality of shim eyebolts securing the rip-out shim to the diaphragm;

a plurality of shim shackles;

a plurality of shim cables connecting the plurality of shim shackles; and a connecting cable having one end thereof connected to the rip-out eyebolt and the other end thereof to a shim shackles of the plurality of shim shackles.

9. The diaphragm assembly of claim 8 wherein the rip-out shim comprises:

an annular circular member having a cable rim secured thereto, a plurality of reinforcing members secured to the annular circular member and the cable rim secured thereto, a plurality of eyebolt pads, a rip-out cable lug, and at least one rip-out cable bearing pin.

10. The diaphragm assembly of claim 9 wherein the diaphragm assembly further comprises:

a plurality of compression fittings sealingly engaging the diaphragm, the rip-out eyebolt, and the plurality of shim eyebolts.

11. The diaphragm assembly of claim 10 wherein the rip-out cable is wrapped at least one full revolution about the cable rim portion of the rip-out shim.

12. The diaphragm assembly of claim 11 wherein the diaphragm assembly further comprises:

a plurality of fasteners securing the pair of flat annular plates and the diaphragm together.

13. A diaphragm assembly used to seal either the jacket leg or pile sleeve of an offshore platform, the diaphragm assembly comprising:

a diaphragm;

a pair of flat annular plates retaining the diaphragm therebetween, one of the flat annular plates being secured to either said jacket leg or said pile sleeve; and a diaphragm rip-out assembly for severing a portion of the diaphragm from between the pair of flat annular plates, the diaphragm rip-out assembly comprising:

a rip-out shim;

a rip-out eyebolt; and a rip-out cable having one end thereof secured to the rip-out eyebolt and the other end thereof secured to the rip-out shim.

14. The diaphragm assembly of claim 13 wherein the rip-out assembly further comprises:

a plurality of shim eyebolts securing the rip-out shim to the diaphragm;

a plurality of shim shackles;

a plurality of shim cables connecting the plurality of shim shackles; and a connecting cable having one end thereof connected to the rip-out eyebolt and the other end thereof to a shim shackles of the plurality of shim shackles.

15. The diaphragm assembly of claim 14 wherein the rip-out shim comprises:

an annular circular member having a cable rim secured thereto, a plurality of reinforcing members secured to the annular circular member and the cable rim secured thereto, a plurality of eyebolt pads, a rip-out cable lug, and at least one rip-out cable bearing pin.

16. The diaphragm assembly of claim 15 wherein the diaphragm assembly further comprises:

a plurality of compression fittings sealingly engaging the diaphragm, the rip-out eyebolt, and the plurality of shim eyebolts.

17. The diaphragm assembly of claim 16 wherein the rip-out cable is wrapped at least one full revolution about the cable rim portion of the rip-out shim.

18. The diaphragm assembly of claim 17 wherein the diaphragm assembly further comprises:

a plurality of fasteners securing the pair of flat annular plates and the diaphragm together.

* * * * *

UNITED STATES PATENT AND TRADEMARK OFFICE

CERTIFICATE OF CORRECTION

PATENT NO. : 4,576,522

DATED : March 18, 1986

INVENTOR(S) : Tommie A. Freeman

It is certified that error appears in the above-identified patent and that said Letters Patent is hereby corrected as shown below:

In column 2, line 56, following the word "FIG." insert --4 is--.
In column 5, line 41, following the words "the pair of" insert --flat annular--.
In column 5, line 41, following the word "plates" insert --, the rip-out assembly comprises:
a rip-out shim;
a rip-out eyebolt; and
a rip-out cable having one end thereof secured to the rip-out eyebolt and the other end thereof secured to the rip-out shim--.

Signed and Sealed this

Second Day of December, 1986

*Attest:*

DONALD J. QUIGG

*Attesting Officer*

*Commissioner of Patents and Trademarks*